US006368409B1

(12) United States Patent
Borsuk et al.

(10) Patent No.: US 6,368,409 B1
(45) Date of Patent: Apr. 9, 2002

(54) ELECTROSTATIC DISPENSING APPARATUS AND METHOD

(75) Inventors: James M. Borsuk, Westlake, OH (US); Laurence B. Saidman, Duluth, GA (US); James W. Schmitkons, Lorain, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/429,821

(22) Filed: Oct. 29, 1999

Related U.S. Application Data

(63) Continuation-in-part of application No. 08/977,796, filed on Nov. 25, 1997, now abandoned.

(51) Int. Cl.[7] ..... B05B 5/025; B05C 5/00

(52) U.S. Cl. ..... 118/621; 118/620; 118/623; 427/472

(58) Field of Search ..... 118/620, 621, 118/623, 627, 629, 630, 636, 640, 407, 410, 413, 419, 411; 427/457, 458, 472; 156/379.6; 239/659, 696; 425/174.8 E

(56) References Cited

U.S. PATENT DOCUMENTS

| | | | | |
|---|---|---|---|---|
| 3,093,309 A | * | 6/1963 | Watanabe | 118/629 |
| 3,577,198 A | | 5/1971 | Beam | 346/75 |
| 3,911,161 A | | 10/1975 | Nord et al. | 427/30 |
| 3,939,800 A | | 2/1976 | Banker | |
| 4,142,010 A | | 2/1979 | Pipkin et al. | |
| 4,513,683 A | | 4/1985 | Kisler | |
| 4,749,125 A | | 6/1988 | Escallon et al. | 239/3 |
| 4,830,872 A | | 5/1989 | Grenfell | 427/30 |
| 4,904,174 A | | 2/1990 | Moosmayer et al. | 425/174.8 E |
| 5,085,891 A | | 2/1992 | Evans | |
| 5,086,973 A | | 2/1992 | Escallon et al. | 239/3 |
| 5,122,048 A | | 6/1992 | Deeds | 425/174.8 E |
| 5,332,154 A | | 7/1994 | Maier et al. | 239/3 |
| 5,421,921 A | * | 6/1995 | Gill et al. | 156/62.4 |
| 5,441,204 A | | 8/1995 | Tappel et al. | 239/708 |
| 5,552,012 A | | 9/1996 | Morris et al. | |

FOREIGN PATENT DOCUMENTS

EP 0194074 A1 9/1986

* cited by examiner

*Primary Examiner*—Curtis Mayes
*Assistant Examiner*—Yewebdar T Tadesse
(74) *Attorney, Agent, or Firm*—Wood, Herron & Evans, LLP

(57) ABSTRACT

An electrostatic dispensing system for dispensing flowable liquid material onto a moving substrate. The electrostatic dispensing system includes multiple liquid dispensers that are aligned along a common axis and supported in spaced, non-contacting relationship on one side of the moving substrate. Each of the liquid dispensers includes a valve to control the flow of fluid through the dispenser. An electrostatic field generator is supported in spaced, non-contacting relationship on the opposite side of the moving substrate to generate an electrostatic field through the moving substrate. The electrostatic field operates to attract flowable liquid material from dispensing outlets associated with the multiple liquid dispensers as a series of spaced, continuous streams or beads which intersect a surface of the moving substrate facing the liquid dispensers. The beads of flowable material are deposited on the surface of the moving substrate in a series of uniform, continuous beads which are formed generally parallel to a direction of travel of the moving substrate. Methods of electrostatically dispensing flowable material onto a moving substrate are also disclosed.

8 Claims, 2 Drawing Sheets

ELECTROSTATIC DISPENSING APPARATUS AND METHOD

CROSS-REFERENCE

The present invention is a continuation-in-part of U.S. Ser. No. 08/977,796, filed on Nov. 25, 1997, now abandoned, the disclosure of which is hereby incorporated herein by reference in its entirety.

FIELD OF THE INVENTION

The present invention relates generally to non-contact dispensing systems for dispensing flowable material onto a substrate and, more particularly, to an electrostatic dispensing system for electrostatically dispensing flowable material onto a moving substrate.

BACKGROUND OF THE INVENTION

In known electrostatic dispensing systems and processes for electrostatically dispensing flowable liquid materials onto a substrate, the flowable material is typically dispensed from one or more dispensing outlets and directed toward a target surface of the substrate. The dispensing outlet of the electrostatic dispenser may comprise either a series of closely spaced nozzles or an elongated slot which receives flowable liquid material at a controlled flow rate and hydrostatic pressure from a fluid delivery system. Where spray nozzles are used as dispensing outlets, the flowable liquid material is typically atomized into a fine particle spray for providing a uniform coating on a surface of the substrate. A dispensing nozzle having an elongated slot outlet, on the other hand, typically provides either a series of spaced, continuous beads of flowable material or a series of spaced, discontinuous streams of droplets which are applied to the surface of the substrate.

The flowable liquid material in an electrostatic dispensing process is electrically biased relative to the target substrate to cause an electrostatic force attraction between the dispensed material and the substrate. The electrostatic force is created by electrically charging components of the dispensing nozzle in contact the flowable material, while the electrically conductive substrate is simultaneously grounded. The required charging voltage for the dispensing nozzle is provided by coupling a high voltage power supply, generally having an output voltage range between 10–50 kV, to conductive components of the dispensing nozzle in contact with the flowable material. In this way, the voltage potential created between the charged dispensing nozzle and the grounded substrate creates an electrostatic force which causes the charged continuous beads or discontinuous droplets of liquid material to be attracted to the grounded substrate.

Electrostatic dispensing systems having charged dispensing nozzles are generally not well suited for dispensing applications which require heating of the nozzle to melt the flowable liquid material prior to dispensing. In these applications, the heating element mounted within the dispensing nozzle must be electrically isolated from the charged components of the nozzle through the use of nonconductive materials, such as plastic. However, the nonconductive materials typically employed are not good thermal conductors and therefore make heating of the dispenser nozzle difficult. Moreover, the known alternative of electrically isolating high voltage electrodes within an electrically conductive dispensing nozzle body requires complex internal charging and isolating devices to be incorporated into the nozzle. Additionally, in applications that require electrostatic dispensing of flowable materials on non-conductive substrates, it is not possible to ground the substrate to create the necessary electrostatic attraction between the flowable material and the substrate.

The electrostatic dispensing system disclosed in U.S. Ser. No. 08/977,796, now abandoned previously incorporated herein by reference and owned by the common assignee, solves these shortcomings and drawbacks by providing an elongated dispensing nozzle supported in spaced relationship relative to an electrostatic field generator. The dispensing nozzle is supported in spaced, non-contacting relationship on one side of the moving substrate, and the electric field generator is supported in spaced, non-contacting relationship on the other side of the moving substrate. The spacing between the dispensing nozzle and electrostatic field generator defines a space for receiving the moving substrate.

Flowable liquid material, such as pressure sensitive hot melt adhesive, is supplied to the dispensing nozzle at a controlled rate and low hydraulic pressure from a material delivery system. The electrostatic field generator is operable to generate an electrostatic field through the moving substrate to attract flowable liquid material from the dispensing nozzle in a series of uniformly spaced, continuous beads or streams. The continuous beads of flowable liquid material are intercepted by the moving substrate and carried away as parallel beads on the surface of the moving substrate facing the dispensing nozzle.

The dispensing nozzle disclosed in U.S. Ser. No. 08/977,796, now abandoned comprises a pair of mating die bodies which include an internal shim and a grounded distribution plate to define an elongated dispensing slot along a lower edge of the nozzle. The distribution plate has a series of uniformly spaced teeth extending slightly beyond the lower edge of the dispensing nozzle which define the even spacing of the continuous material beads deposited on the moving substrate when the longitudinal axis of the dispensing nozzle is arranged perpendicularly to the direction of travel of the moving substrate. As the dispensing nozzle of U.S. Ser. No. 08/977,796 is grounded rather than being charged by a high voltage power supply, the dispensing nozzle may be made of metal or any other suitable material having good thermal conductivity for improved heating of the nozzle. Moreover, the grounded dispensing nozzle eliminates the need for incorporating any complex internal charging or isolating devices in the nozzle.

Notwithstanding the advances made by the electrostatic dispensing system disclosed in the present assignee's U.S. Ser. No. 08/977,796, there is still a need for an electrostatic dispensing system that reduces the volume of liquid material within the dispensing head of the liquid dispenser to improve shut-off capability of the dispenser. There is still also a need for an electrostatic dispensing system that provides the ability to mix and match different liquid dispensing technologies and patterns across the width of the substrate.

SUMMARY OF THE INVENTION

To these ends, an electrostatic dispensing system is provided for electrostatically dispensing flowable material onto a moving substrate. The electrostatic dispensing system includes multiple liquid dispensers that are aligned along a common axis and supported in spaced, non-contacting relationship on one side of the moving substrate. An electrostatic field generator is supported in spaced, non-contacting relationship on the opposite side of the moving substrate to generate an electrostatic field through the moving substrate which may be substantially non-conductive.

Flowable liquid material, such as pressure sensitive hot melt adhesive, is supplied to the liquid dispensers at a controlled rate and low hydraulic pressure from one or more metered fluid supplies. The electrostatic field generator is operable to generate an electrostatic field through the moving substrate to attract the flowable liquid material from the liquid dispensers in a series of uniformly spaced, continuous beads or streams. The continuous beads of flowable liquid material are intercepted by the moving substrate and carried away as parallel beads on the surface of the moving substrate facing the dispensing nozzle.

In one aspect of the present invention, each of the liquid dispensers includes a shim having multiple elongated fluid passageways formed through the thickness of the shim. The elongated fluid passageways are generally parallel and define multiple dispensing outlets along an elongated, interrupted edge of the shim. Each of the liquid dispensers further includes a distribution plate mounted adjacent the shim that terminates in either a serrated or scalloped edge proximate the dispensing outlets formed in the shim. The elongated fluid passageways of the shim are aligned with teeth formed on the edge of the distribution plate so that the spacing between the teeth generally defines the spacing between the continuous beads dispensed onto the substrate. Each of the liquid dispensers includes a valve to control the flow of the liquid material through the dispensing outlets.

The multiple liquid dispensers and electrostatic field generator of the present invention are operable to produce controlled patterns of flowable material on a moving substrate with low add-on weight, accurate bead placement and high pattern repeatability. The provision of multiple liquid dispensers along a common axis, with each dispenser having a selectively operable valve, minimizes the volume of liquid material in the dispenser to improve cut-off of the dispensed bead pattern over larger dispensing nozzles. Further, the multiple liquid dispensers of the present invention provide the unique ability to mix and match different liquid dispensing technologies and patterns, such as electrostatically applied continuous parallel beads with non-electrostatically applied swirl patterns, flat ribbons, or fibrous webs of liquid material, across the width of the substrate.

The above features and advantages of the present invention will be better understood with reference to the accompanying figures and detailed description.

BRIEF DESCRIPTION OF THE DRAWINGS

Reference will now be made to the accompanying figures from which the novel features and advantages of the present invention will be apparent.

DETAILED DESCRIPTION OF THE INVENTION

Figure 1:
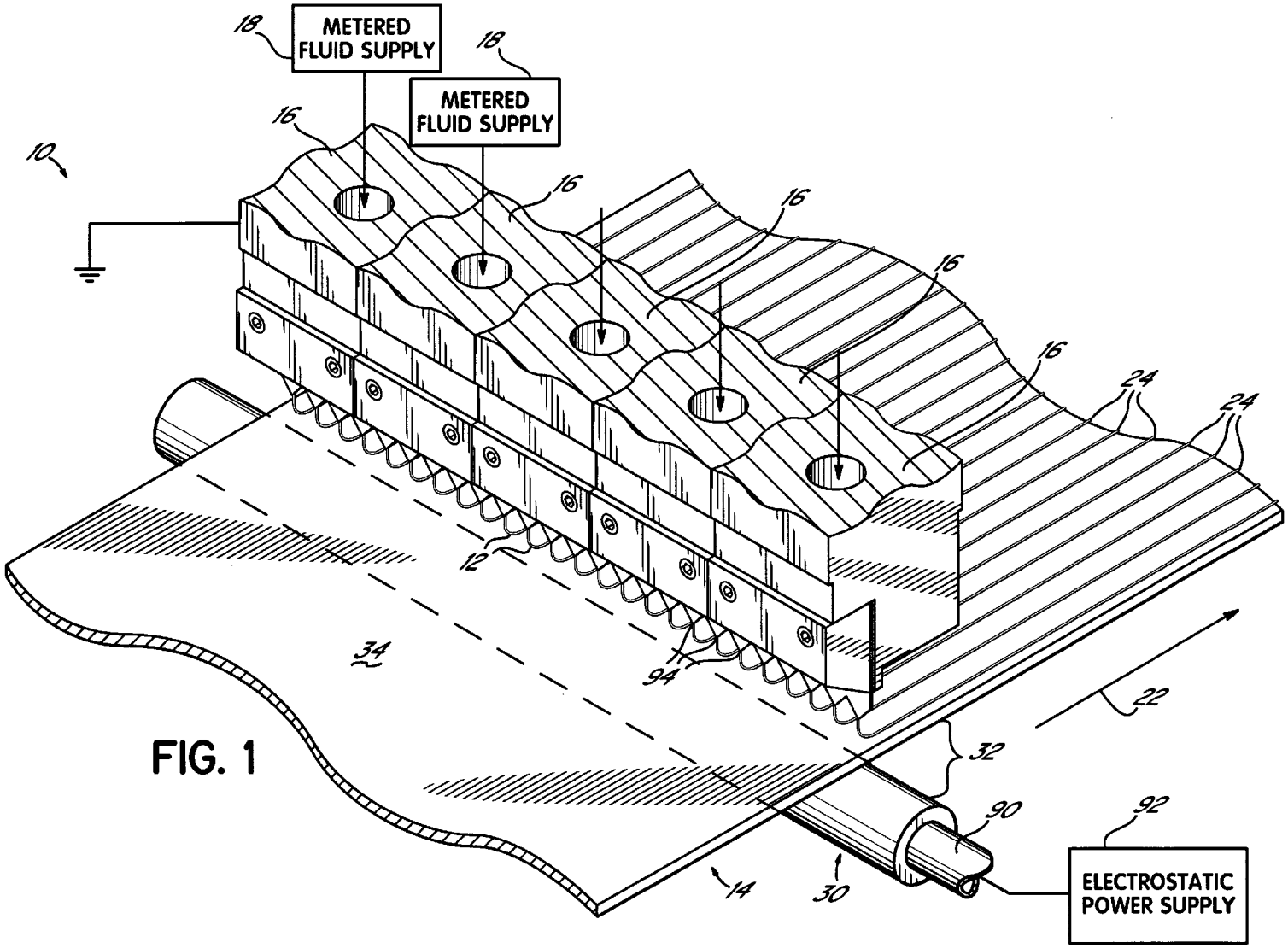
FIG. 1 is a perspective view of an electrostatic dispensing system in accordance with the principles of the present invention including multiple liquid dispensers aligned along a common axis for electrostatically dispensing flowable material onto a moving substrate.

With reference to the figures, and to FIG. 1 in particular, an electrostatic dispensing system 10 in accordance with the principles of the present invention is shown for electrostatically dispensing flowable liquid material 12, such as pressure sensitive hot melt adhesive, for example, onto a moving substrate 14. The electrostatic dispensing system 10 includes multiple liquid dispensers 16 that are aligned along a common axis as shown in FIG. 1. The liquid dispensers 16 are connected to one or more material delivery systems, such as metered fluid supply or supplies 18, so that each liquid dispenser 16 receives a controlled or metered flow of liquid material 12 for dispensing onto the moving substrate 14 as described in detail below.

Each liquid dispenser 16 includes a valved fluid dispenser body 20 (FIG. 2) for controlling the flow of material 12 through the liquid dispenser 16. For example, each dispenser body 20 may be a Model H200 mini-bead module manufactured and sold by the assignee of the present invention, Nordson Corporation of Westlake, Ohio. Accordingly, the structure and operation of dispenser body 20 will be described briefly herein for purposes of background only. Liquid dispensers 16 are mounted to a heated adhesive manifold (not shown) and a source of pressurized air (not shown) as will be appreciated by those skilled in the art.

The liquid dispensers 16 are preferably mounted in spaced, non-contacting relationship above the moving substrate 14 which travels relative to the dispensers 16 in a direction represented by arrow 22 in FIG. 1. The moving substrate 14 may be a web of bottom sheet material, for example, which receives a uniform, continuous pattern of adhesive streams or beads 24 from the liquid dispensers 16 before being joined with a web of top sheet material (not shown). As will be described in detail below, each liquid dispenser 16 has a die assembly 26 (FIGS. 2 and 3) mounted at one end via a set of fasteners (not shown) for dispensing the continuous pattern of adhesive streams or beads 24 onto the moving substrate 14.

The electrostatic dispensing system 10 further includes an electrostatic field generator 30 (FIG. 1) which is preferably mounted in spaced, non-contacting relationship below the moving substrate 14. The preferred spaced arrangement of liquid dispensers 16 and the electrostatic field generator 30 defines a receiving space 32 for the moving substrate 14 to travel between the liquid dispensers 16 and the electrostatic field generator 30 as shown in FIG. 1. As will be described in more detail below, the electrostatic field generator 30 is operable to generate an electrostatic field through the movable substrate 14, which itself may be a substantially non-conductive material, to attract or draw the beads 24 of flowable liquid material from the liquid dispensers 16 in a direction which intersects the moving substrate 14. In this way, a uniform, continuous pattern of streams or beads 24 may be formed across an upper surface 34 of the moving substrate 14 before it is joined with a second substrate to form a multi-ply, bonded structure.

For example, electrostatic dispensing system 10 may be used in a diaper production line to adhesively join a polymeric liquid barrier sheet to a nonwoven absorbent layer, or in a multi-ply tissue paper production line wherein individual plies of tissue paper must be adhesively joined together. Those skilled in the art will readily appreciate the various applications to which the present invention is susceptible. For a detailed description on the structure and operation of the electrostatic field generator 30, the reader is referred to the disclosure of U.S. Ser. No. 08/977,796, now abandoned previously incorporated herein by reference in its entirety.

Figures 2, 2A, 3:
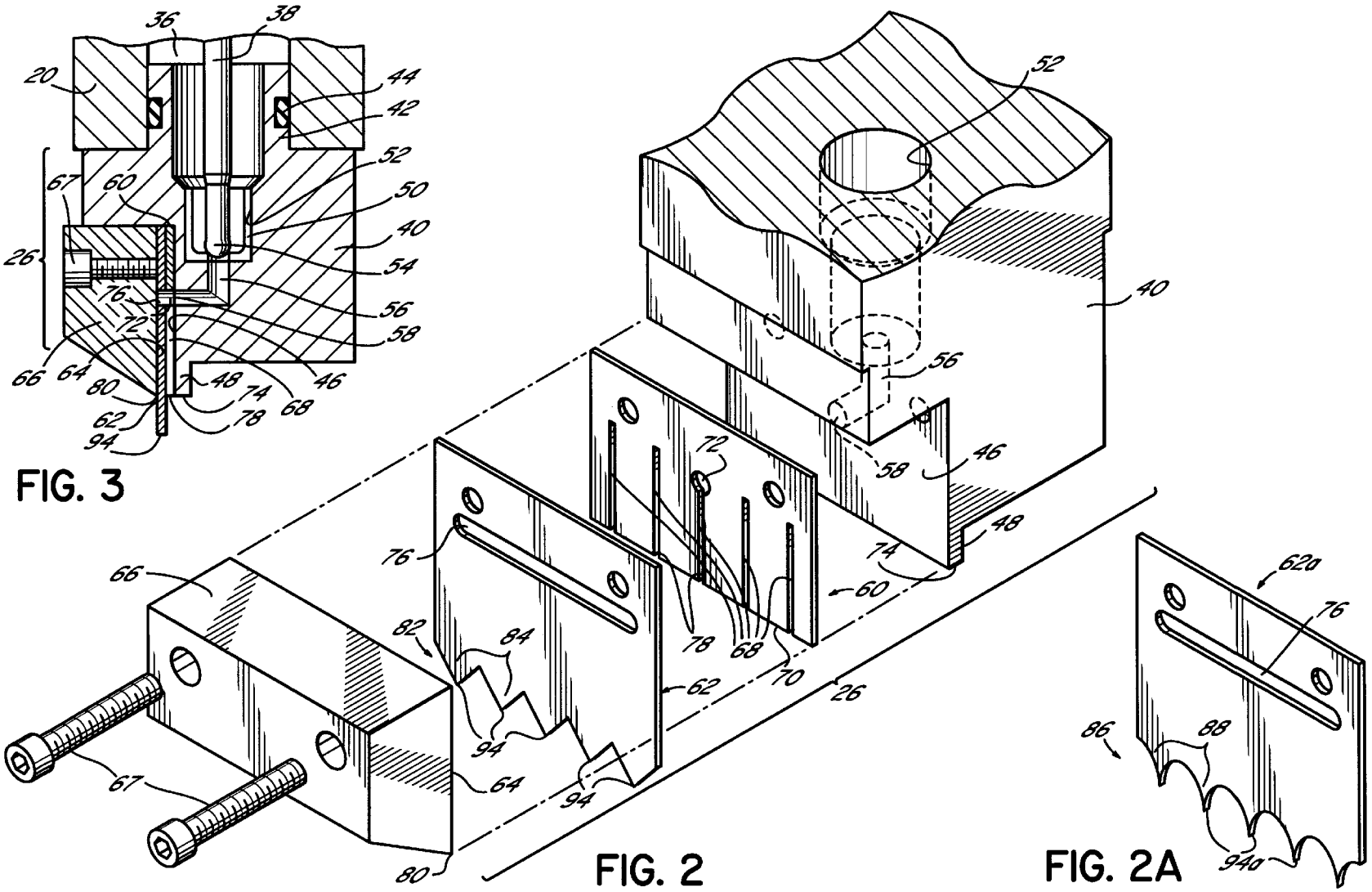
FIG. 2 is an exploded perspective view illustrating components of one of the liquid dispensers shown in FIG. 1.
FIG. 2A illustrates an alternative embodiment of the serrated shim shown in FIG. 2.
FIG. 3 is a side elevational view, partially in cross-section, of a liquid dispenser shown in FIG. 1.

Referring now to FIGS. 2 and 3, each dispenser body 20 of the liquid dispensers 16 includes an fluid cavity or supply passage 36, and a selectively retractable valve plunger 38 that extends axially downwardly into the fluid cavity 36. In one embodiment of the present invention, each die assembly includes a die body 40 having an integral mounting end 42 (FIG. 3) that extends into a lower end of the adhesive cavity 36 and is sealed with walls of the fluid cavity 36 via an O-ring 44 (FIG. 3). Each die body 40 includes a substantially vertical face 46 that terminates in a lip 48 at an end remote from the mounting end 42. A valve seat 50, preferably made of carbide, is located in a stepped bore 52 of the die body 40 which cooperates with a ball 54 formed on a remote end of the valve plunger 38 for providing controlled intermittent supply of fluid material, such as hot melt adhesive, to a fluid passageway 56 formed in the die body 40. The fluid passageway 56 communicates at one end with the fluid cavity 36 of the dispenser body 20 and terminates at an opposite end as a fluid outlet 58 formed in the vertical face 46 of the die body 40.

Further referring to FIGS. 2 and 3, each die assembly 26 further includes a shim 60 and a distribution plate 62 which are positioned and secured between the vertical face 46 of die body 40 and a vertical face 64 of a tapered clamping member 66 through a set of fasteners 67. As shown most clearly in FIG. 2, shim 60 includes multiple elongated fluid passageways 68 formed through the thickness of the shim 60 that extend generally in parallel to an elongated edge 70 of the shim 60. An aperture 72 is formed through the thickness of shim 60 that may communicate with one of the elongated fluid passageways 68, depending on the positioning of the elongated passageways 68 in the shim 60. Aperture 72 is registered to communicate with the fluid outlet 58 in die body 40 when the die assembly 26 is mounted to the die body 40.

As shown in FIG. 3, the elongated, interrupted edge 70 of shim 60 terminates adjacent an elongated edge 74 of the die body lip 68. Distribution plate 62 includes an elongated aperture 76 that extends transverse to the orientation of the shim fluid passageways 68. In this way, the elongated aperture 76 of the distribution plate 62 communicates with each of the fluid passageways 68 and aperture 72 formed in the shim 60. As will be described below, fluid material is fed from the fluid outlet 58 of the die body 40, through the aperture 72 formed in shim 60, and to the elongated aperture 76 formed in the distribution plate 62. The elongated aperture 76 of distribution plate 62 feeds the fluid material to each of the elongated fluid passageways 68 formed in the shim 60.

In combination with the vertical face 46 of the die body 20 on one side, and the distribution plate 62 on the other side, the elongated fluid passageways 68 formed in the shim 60 define multiple liquid material dispensing outlets 78 along the elongated, interrupted edge 70 of shim 60. The dispensing outlets 78 dispense liquid material 12 along a lower portion of the distribution plate 62 which extends slightly beyond an elongated edge 80 of the tapered clamping member 66 and the elongated edge 74 of the die body lip 48.

In one embodiment of the present invention as shown in FIG. 2, the distribution plate 62 terminates in a serrated edge 82 which extends slightly beyond the respective elongated edges 74 and 80 of the die body lip 48 and the tapered clamping member 66. For purposes to be described in more detail below, the serrated edge 82 has teeth 84 which have centerlines spaced about ¼" apart, although other spacings of teeth 84 are possible for providing different spacings of the streams or beads 24 as will be discussed in more detail below. It will be appreciated that the minimal spacing of teeth 84 must be chosen to insure that the flowable material 12 does not bridge the gap between adjacent teeth 84. Each of the elongated fluid passageways 68 of the shim 60 is aligned with a respective one of the teeth 84. Alternatively, as shown in FIG. 2A, a modified distribution plate **62*a* is shown that terminates in a scalloped edge 86 which also extends slightly beyond the respective elongated edges 74 and 80 of the die body lip 48 and the tapered clamping member 66. The scalloped edge 86 has teeth 88 which also have centerlines spaced about ¼" apart, although other spacings of teeth 88 are possible for providing different spacings of the streams or beads 24. In this embodiment, each of the elongated fluid passageways 68 of the shim 60 is aligned with a respective one of the teeth 88**.

As shown in FIG. 1, the electrostatic field generator 30 is preferably mounted in spaced, non-contacting relationship below the moving substrate 14 through a support structure (not shown). The electrostatic field generator 30 preferably includes an electrostatic cable 90 which is coupled to an electrostatic power supply 92, such as a Model EPU-9 electrostatic power supply commercially available from Nordson Corporation of Westlake, Ohio, assignee of the present invention. Electrostatic power supply 92 is preferably operable to generate between a 5 kV and 50 kV electrostatic field during operation of the electrostatic field generator 30 as will be described in more detail below.

Before the electrostatic dispensing operation begins, the liquid dispensers 16 are heated to a controlled temperature via conduction with the heated adhesive manifold (not shown), and the liquid dispensers 16 are grounded as shown in FIG. 1, thereby grounding distribution plate 62 in contact with liquid material 12. Flowable material 12 is delivered from the metered fluid supply or supplies 18 at a controlled rate and at a low hydraulic pressure to the liquid dispensers 12. Liquid material 12 may comprise a pressure sensitive hot melt adhesive, such as National Starch's 34-5590, for example, which has the desired rheological and adhesive properties for the electrostatic dispensing application. When the electrostatic power supply 92 is turned on, the electrostatic field generator 30 generates a 5 kV to 50 kV electrostatic field between the generator 30 and the liquid dispensers 16 which passes through the moving substrate 14. Moving substrate 14 may comprise a non-conductive woven or nonwoven web of material, or a polymeric film, for example, which permits the electrostatic field generated by the electrostatic field generator 30 to pass through the web.

As shown in FIG. 1, as flowable material 12 exits the dispensing outlets 78, it is carried along a portion of the distribution plate 62 which extends beyond the respective elongated edges 74 and 80 of the die body lip 48 and the tapered clamping member 66. The electrostatic field generated by the electrostatic field generator 30 through the moving substrate 14 attracts and pulls the streams or beads 24 of flowable liquid material generally from the spaced points or apexes 94 and **94*a* of the teeth 84 and teeth 88, respectively, in a direction which intersects the moving substrate 14. Thus, the spacing of the apexes 94 and 94*a* of the teeth 84 and teeth 88, such as ¼" apart for example, generally defines the spacing of the streams or beads 24 as they are intercepted and carried away by the moving substrate 14 when the common axis of the liquid dispensers 16 is arranged perpendicularly to the direction of travel 22 of moving substrate 14. Those skilled in the art will appreciate that the number of liquid dispensers 16, and the respective spacing of apexes 94, 94*a* of the teeth 84, 88, may be selected and varied in accordance with the desired overall width of the desired bead pattern in the cross-machine direction and the desired spacing between the individual continuous beads 24**.

As shown in FIG. 1, the beads 24 are deposited on the upper surface 34 of the moving substrate 14 generally parallel to the direction of travel of the web as represented by arrow 22. By varying the speed of the moving substrate 14 and by varying the distance between adjacent beads 24, it is possible in accordance with the principles of the present invention to control the beadwidth of each bead 24 and the add-on weight of flowable material 12 on a material substrate 14. For example, by varying the speed of the moving substrate 14 between about 500 f.p.m. and about 1000 f.p.m., and by varying the distance between adjacent beads 24, it is possible to form beads 24 of flowable material having an approximate diameter which varies between about 0.001 and about 0.002 inches, thereby giving an approximate add-on weight which varies between about 0.088 $g/m^2$ and about 0.336 $g/m^2$. Thus, while the spacing and diameter of the beads 24 formed by the electrostatic dispensing process is generally considered to be a function of the flow rate of flowable material 12 through dispensing outlets 78, the rheological properties of the flowable material 12, and the electrostatic force generated by the electrostatic field generator 30 attracting the beads, the provision of the teeth 84 or teeth 88 on the serrated or scalloped edges 82 and 86 of distribution plates 62, 62*a*, respectively, greatly improves the uniformity of the spaced bead pattern on the substrate 14.

Those skilled in the art will appreciate that the present invention provides an electrostatic dispensing system which is readily adaptable for a number of different dispensing applications. The provision of multiple liquid dispensers 16 along a common axis, with each of the liquid dispensers 16 having a selectively operable valve, has several distinct advantages. For example, as the volume of liquid material downstream of each valve structure in the multiple liquid dispensers 16 is minimized, improved cut-off of the dispensed bead pattern is provided over larger dispensing nozzles. Moreover, with the provision of multiple liquid dispensers, the ability to mix and match different liquid dispensing technologies and patterns, such as electrostatically applied continuous parallel beads with non-electrostatically applied swirl patterns, flat ribbons, or fibrous webs of liquid material, across the width of the substrate can be achieved. The arrangement of the grounded liquid dispensers 16 and electrostatic field generator 30 on opposite sides of the moving substrate 14 provides for electrostatic dispensing of flowable material on nonconductive substrates. Moreover, the provision of the teeth 84 or teeth 88 on the distribution plates 62, 62*a*, respectively, provides uniform patterns of evenly spaced, continuous beads 24 on the upper surface 32 of moving substrate 14 with very low add-on weight.

From the above disclosure of the general principles of the present invention and the preceding detailed description of preferred embodiments, those skilled in the art will readily comprehend the various modifications to which the present invention is susceptible. For example, it is contemplated that the elongated fluid passageways 68 may be alternatively milled in the vertical face 46 of die body 40. Further, while liquid dispensers 16 and electrostatic field generator 30 have been described as being respectively mounted "above" and "below" moving substrate 14, those skilled in the art will appreciate that other orientations of the components and substrate are possible without departing from the spirit and scope of the present invention. The invention in its broader aspects is therefore not limited to the specific details and illustrative example shown and described. Accordingly, departures may be made from such details without departing from the spirit or scope of Applicants' general inventive concept. Therefore, Applicants desire to be limited only by the full legal scope of the following claims.

Having described the invention, we claim:

1. Apparatus for electrostatically dispensing liquid material onto a substantially non-conductive moving substrate, comprising:

a plurality of liquid dispensers aligned on a common axis, each of said liquid dispensers having a plurality of dispensing outlets operable to dispense liquid therefrom; and an electrostatic field generator operable to generate an electrostatic field, said plurality of liquid dispensers and said electrostatic field generator being spaced relative to each other to define an area through which the substrate can move, said electrostatic field being capable of attracting the liquid material in continuous elongated beads from said dispensing outlets onto the moving substrate.

2. The apparatus of claim 1 wherein each of said liquid dispensers further comprises a valve operable to control the flow of liquid material from said plurality of dispensing outlets.

3. The apparatus of claim 1 wherein said common axis of said liquid dispensers is oriented substantially perpendicular to a direction of travel of the moving substrate.

4. The apparatus of claim 1 wherein each of said liquid dispensers comprises a plurality of elongated fluid passageways, each of said elongated fluid passageways terminating in a respective one of said dispensing outlets.

5. The apparatus of claim 1 wherein each of said liquid dispensers comprises a die body, a clamping member, a shim with a plurality of elongated fluid passageways, each of said elongated passageways terminating in a respective one of said dispensing outlets, and a distribution plate mounted adjacent said shim, said distribution plate having an elongated edge proximate said dispensing outlets and a single elongated fluid passageway communicating with each of said plurality of elongated fluid passageways of said shim, said elongated edge comprising a plurality of spaced projections, each of said elongated fluid passageways of said shim being aligned with one of said projections, said shim and said distribution plate being positioned between said die body and said clamping member.

6. The apparatus of claim 5 wherein said plurality of spaced projections comprises a plurality of spaced teeth.

7. Apparatus for electrostatically dispensing liquid material onto a substantially non-conductive moving substrate, comprising:

a liquid dispenser having an outlet; and an electrostatic field generator spaced relative to said liquid dispenser to define an area through which the substrate can move without contacting said electrostatic field generator, said electrostatic field generator being capable of generating an electrostatic field in the area defined by said electrostatic generator and said liquid dispenser and extending through the moving substrate, said electrostatic field being capable of drawing liquid material dispensed from said outlet into a continuous elongated bead which contacts the moving substrate.

8. The apparatus of claim 7 wherein said liquid dispenser further comprises a valve operable to control the flow of liquid material from said dispensing outlet.

* * * * *